US009440475B2

(12) United States Patent
Sakurada et al.

(10) Patent No.: US 9,440,475 B2
(45) Date of Patent: Sep. 13, 2016

(54) IMAGE FORMING METHOD

(71) Applicant: CANON KABUSHIKI KAISHA, Tokyo (JP)

(72) Inventors: Shinichi Sakurada, Tokyo (JP); Takashi Imai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/856,278

(22) Filed: Sep. 16, 2015

(65) Prior Publication Data

US 2016/0082749 A1 Mar. 24, 2016

(30) Foreign Application Priority Data

Sep. 18, 2014 (JP) ..... 2014-190303

(51) Int. Cl.

| | |
|---|---|
| ***B41M 7/00*** | (2006.01) |
| ***B41J 2/01*** | (2006.01) |
| ***B41M 5/00*** | (2006.01) |

(52) U.S. Cl.

CPC ..... *B41M 7/00* (2013.01); *B41M 5/0017* (2013.01)

(58) Field of Classification Search

CPC ..... B41M 7/00; B41M 5/0017
See application file for complete search history.

(56) References Cited

U.S. PATENT DOCUMENTS

2009/0244146 A1* 10/2009 Chiwata ..... B41J 11/002 347/14

FOREIGN PATENT DOCUMENTS

| | | |
|---|---|---|
| JP | 2004-010633 A | 1/2004 |
| JP | 2009-166262 A | 7/2009 |
| JP | 2010-023265 A | 2/2010 |
| JP | 2010-142965 A | 7/2010 |
| JP | 2010-155359 A | 7/2010 |

* cited by examiner

*Primary Examiner* — Geoffrey Mruk
*Assistant Examiner* — Scott A Richmond
(74) *Attorney, Agent, or Firm* — Canon U.S.A., Inc., IP Division

(57) ABSTRACT

A first embodiment is an image forming method having a liquid composition applying step of applying a liquid composition to a recording medium, an ink applying step of applying an ink to the recording medium, and a heating step of heating the recording medium, in which the ink contains a self-dispersible pigment and resin particles, the liquid composition contains an agglomerating component and wax particles, the heating temperature $T_H$ in the heating step, the softening point $Tm_p$ of the resin particles, and the melting point $Tm_w$ of the wax particles satisfy the relationship of $Tm_p<Tm_w\leq T_H$, the penetration of the wax particles is 5 or less, and the application amount to the recording medium of wax particles X having a particle diameter equal to or larger than the film thickness D represented by a prescribed expression among the wax particles is 0.01 g/m$^2$ or more.

8 Claims, 2 Drawing Sheets

IMAGE FORMING METHOD

BACKGROUND OF THE INVENTION

1. Field of the Invention

The present invention relates to an image forming method.

2. Description of the Related Art

In recent years, it has been attempted to apply an ink jet technique to commercial printing of POD (print on demand). In the field of the commercial printing, it has been required to form an image having high definition and scratch resistance at high speed using a widely used recording medium.

As a technique capable of forming a high-definition image at high speed, a method using a treatment liquid containing an agglomerating component which contacts ink to increase the viscosity of the ink is known. For example, Japanese Patent Laid-Open No. 2010-142965 discloses a method including agglomerating a component having an anionic group contained in ink using a treatment liquid containing polyvalent metallic salt and organic acid as an agglomerating component to increase the viscosity of the ink. Japanese Patent Laid-Open No. 2004-10633 discloses an ink jet recording ink set containing an ink containing a pigment and a liquid composition having an action of agglomerating the ink, in which either the ink or the liquid composition is alkaline and the other one is acidic.

As a method for giving high scratch resistance to an image to be obtained, Japanese Patent Laid-Open No. 2010-23265 discloses adding cationic polyurethane and a polyether modified polysiloxane compound to a treatment liquid. Japanese Patent Laid-Open No. 2010-155359 discloses adding a lubricant, such as wax, to ink. Japanese Patent Laid-Open No. 2009-166262 discloses a method including applying an image-treating liquid containing hot-melt particles to an image, and then heating the same to the melting point of the hot-melt particles or higher.

SUMMARY OF THE INVENTION

A first embodiment of the present invention is an image forming method having a liquid composition applying step of applying a liquid composition to a recording medium, an ink applying step of applying an ink to the recording medium in such a manner as to be at least partially overlapped with a region to which the liquid composition is applied, and a heating step of heating the recording medium to which the liquid composition and the ink are applied, in which the ink contains a self-dispersible pigment and resin particles, the liquid composition contains an agglomerating component of agglomerating at least either the self-dispersible pigment or the resin particles and wax particles, the heating temperature $T_H$ in the heating step, the softening point $Tm_p$ of the resin particles, and the melting point $Tm_w$ of the wax particles satisfy the relationship of $Tm_p<Tm_w\leq T_H$, the penetration specified by JIS K2235 of the wax particles is 5 or less, and the application amount to the recording medium of wax particles X having a particle diameter equal to or larger than the film thickness D represented by the following expression (1) among the wax particles is 0.01 g/m$^2$ or more; Expression (1): $D=a\times(b_2/c_2+b_2/c_2)$ (In the expression, a is the application amount (g/m$^2$) to the recording medium of the ink, $b_1$ is the content (% by mass) of the self-dispersible pigment in the ink, $c_1$ is the specific gravity of the self-dispersible pigment, $b_2$ is the content (% by mass) of the resin particle in the ink, and $c_2$ is the specific gravity of the resin particle.).

A second embodiment of the present invention is an image forming method having a liquid composition applying step of applying a liquid composition to a recording medium, an ink applying step of applying an ink to the recording medium in such a manner as to be at least partially overlapped with a region to which the liquid composition is applied, and a heating step of heating the recording medium to which the liquid composition and the ink are applied, in which the ink contains a pigment, a resin dispersant, and resin particles, the liquid composition contains an agglomerating component of agglomerating at least either the pigment or the resin particles and wax particles, the heating temperature $T_H$ in the heating step, the softening point $Tm_p$ of the resin particles, and the melting point $Tm_w$ of the wax particles satisfy the relationship of $Tm_p<Tm_w\leq T_H$, the penetration specified by JIS K2235 of the wax particles is 5 or less, and the application amount to the recording medium of wax particles X having a particle diameter equal to or larger than the film thickness D represented by the following expression (2) among the wax particles is 0.01 g/m$^2$ or more; Expression (2): $D=a\times(b_1/c_1+b_2/c_2+b_3/c_3)$ (In the expression, a is the application amount (g/m$^2$) to the recording medium of the ink, $b_1$ is the content (% by mass) of the pigment in the ink, $c_1$ is the specific gravity of the pigment, $b_2$ is the content (% by mass) of the resin particles in the ink, $c_2$ is the specific gravity of the resin particles, $b_3$ is the content (% by mass) of the resin dispersant in the ink, and $c_3$ is the specific gravity of the resin dispersant.).

Further features of the present invention will become apparent from the following description of exemplary embodiments with reference to the attached drawings.

DESCRIPTION OF THE EMBODIMENTS

Figure 1A:
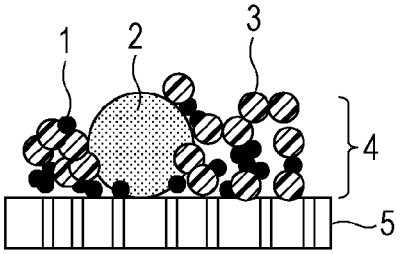
FIGS. 1A to 1D are schematic cross sectional views for explaining the state on a recording medium in embodiments of the present invention.

In Japanese Patent Laid-Open No. 2010-23265, by increasing the adhesiveness between a printing layer and paper and making it possible to easily more uniformly apply a coating liquid by reducing the surface tension, the scratch resistance of the printing layer is increased. However, the surface of the printing layer is sometimes scraped with the scratch, and thus a further improvement is desired from the viewpoint of sufficient scratch resistance. When a lubricant, such as wax, is added to ink as in Japanese Patent Laid-Open No. 2010-155359, ink ejection is sometimes become unstable. When a component having a protective action is applied to an image to form a protective film as in Japanese Patent Laid-Open No. 2009-166262, a step is newly added, which sometimes reduces the productivity.

Thus, the present invention is directed to providing an image forming method capable of obtaining an image having high definition and high scratch resistance.

An embodiment of the present invention is an image forming method having the following steps: a liquid composition applying step of applying a liquid composition to a recording medium; an ink applying step of applying an ink to the recording medium in such a manner as to be at least partially overlapped with a region to which the liquid composition is applied; and a heating step of heating the recording medium to which the liquid composition and the ink are applied.

In a first embodiment of the present invention, the ink contains a self-dispersible pigment and resin particles and the liquid composition contains an agglomerating component of agglomerating at least either the self-dispersible pigment or the resin particles and wax particles. The heating temperature $T_H$ in the heating step, the softening point $Tm_p$ of the resin particles, and the melting point $Tm_w$ of the wax particles satisfy the relationship of $Tm_p<Tm_w\leq T_H$. The penetration specified by JIS K2235 of the wax particles is 5 or less. The application amount to the recording medium of wax particles X having a particle diameter equal to or larger than the film thickness D represented by the following expression (1) among the wax particles is 0.01 g/m$^2$ or more.

$$D=a\times(b_1/c_1+b_2/c_2) \quad \text{Expression (1):}$$

(In the expression, a is the application amount (g/m$^2$) to the recording medium of the ink, $b_1$ is the content (% by mass) of the self-dispersible pigment in the ink, $c_1$ is the specific gravity of the self-dispersible pigment, $b_2$ is the content (% by mass) of the resin particle in the ink, and $c_2$ is the specific gravity of the resin particle.)

In a second embodiment of the present invention, the ink contains a pigment, a resin dispersant, and resin particles and the liquid composition contains an agglomerating component of agglomerating at least either the pigment or the resin particles and wax particles. The heating temperature $T_H$ in the heating step, the softening point $Tm_p$ of the resin particles, and the melting point $Tm_w$ of the wax particles satisfy the relationship of $Tm_p<Tm_w\leq T_H$. The penetration specified by JIS K2235 of the wax particles is 5 or less. The application amount to the recording medium of wax particles X having a particle diameter equal to or larger than the film thickness D represented by the following expression (2) among the wax particles is 0.01 g/m$^2$ or more.

$$D=a\times(b_1/c_1+b_2/c_2+b_3/c_3) \quad \text{Expression (2):}$$

(In the expression, a is the application amount (g/m$^2$) to the recording medium of the ink, $b_1$ is the content (% by mass) of the pigment in the ink, $c_1$ is the specific gravity of the pigment, $b_2$ is the content (% by mass) of the resin particles in the ink, $c_2$ is the specific gravity of the resin particles, $b_3$ is the content (% by mass) of the resin dispersant in the ink, and $c_3$ is the specific gravity of the resin dispersant.)

Due to the configurations of the embodiments, an image forming method capable of obtaining an image having high definition and high scratch resistance can be provided.

The mechanism of the effects of the embodiments is assumed as follows.

First, the agglomerating component and the wax particles are disposed on the recording medium by the liquid composition applying step. Next, by the ink applying step, the ink is applied to the recording medium, so that the ink and the liquid composition are brought into contact with each other. The order of the liquid composition applying step and the ink applying step is not limited and the ink applying step can also be performed first. When the ink and the liquid composition contact, the pigment and the resin particles in the ink agglomerate. In this case, the configuration of the recording medium is as illustrated in FIG. 1A. In FIG. 1A, the reference numeral 1 denotes a pigment (for example, a self-dispersible pigment), the reference numeral 2 denotes a wax particle, the reference numeral 3 denotes a resin particle, the reference numeral 4 denotes an ink aggregation layer, and the reference numeral 5 denotes a recording medium.

Figure 1B:
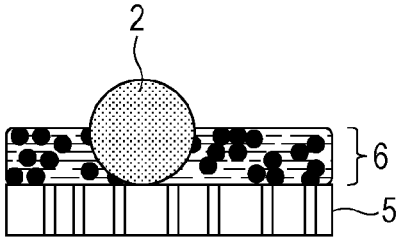
Figure 1C:
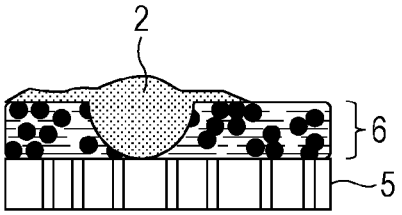

Next, when the recording medium is heated to reach a temperature equal to or higher than the softening point ($Tm_p$) of the resin particles and less than the melting point ($Tm_w$) of the wax particles, the resin particles form a film, so that an ink film 6 is formed as illustrated in FIG. 1B. Then, when the temperature reaches a temperature equal to or higher than the melting point of the wax particles, the wax particles are melted as illustrated in FIG. 1C. FIG. 1B illustrates the wax particle 2 larger than the thickness of the ink film 6. As a result of an examination of the present inventors, it has been found that the film thickness D represented by Expression (1) and the like in this embodiment has a correlation with the actual thickness of the ink film 6 and is almost equal to the actual thickness of the ink film 6. In this embodiment, the wax particles contain wax particles X having a particle diameter equal to or larger than the film thickness D represented by Expression (1) and the like and the application amount to the recording medium of the wax particles X is 0.01 g/m$^2$ or more. Therefore, a large number of wax particles having a particle diameter equal to or larger than the ink film thickness as illustrated in FIG. 1B are present. Due to the presence of a large number of wax particles having a particle diameter equal to or larger than the ink film thickness, a large number of regions where the melted wax is present on the ink film 6 are formed by heating as illustrated in FIG. 1 (C). Then, the wax can function as a protective film to protect an image.

Figure 1D:
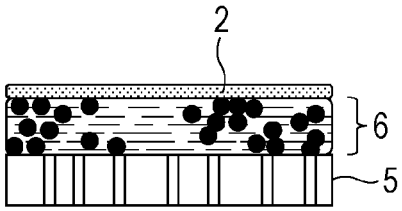

In the heating step, by pressurizing an image using a roller or the like in the state where the recording medium is heated to a temperature equal to or higher than the melting point of the wax particles, the melted wax can be effectively spread on the ink film as illustrated in FIG. 1D, and thus the pressurization is suitable.

In this embodiment, the penetration of the wax particles is 5 or less. By the use of the wax particles having a penetration of 5 or less, the hardness of the protective film containing the wax becomes high and the friction coefficient on the surface of the image decreases, and therefore high scratch resistance can be obtained.

Figure 2:
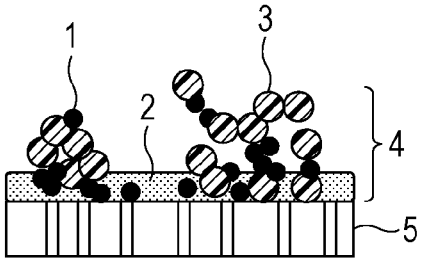
FIG. 2 is a schematic cross sectional view for explaining the mechanism of the effects of the present invention.

When the melting point of the wax is lower than the softening point of the resin particles, the wax particles are melted first as illustrated in FIG. 2, so that a wax component permeates into the ink film. Therefore, it is considered that the protective film containing the wax component is not effectively formed on the ink film surface, so that excellent scratch resistance cannot be obtained.

Hereinafter, the embodiments of the present invention are described.

Ink Applying Step

In the ink applying step, the ink containing a pigment and resin particles is applied to the recording medium. In the present invention, the ink is suitably applied to the recording medium using a recording head of an ink jet system.

The ink for use in the present invention contains a pigment and resin particles. In the first embodiment, the pigment is a self-dispersible pigment. In the second embodiment, the pigment is dispersed by a resin dispersant (hereinafter also referred to as a "resin dispersion pigment").

As the pigment, known former inorganic pigments and organic pigments can be mentioned. For example, specifically, pigments represented by the C.I. (color index) number can be used. As a black pigment, carbon black is suitably used.

In the second embodiment, the ink contains a resin dispersant which disperses a pigment. The resin dispersant is not particularly limited and known resin dispersants can be used, for example. The resin dispersant is suitably a water-soluble dispersant having a hydrophilic part and a hydrophobic part in the structure. In particular, a resin dispersant obtained by copolymerizing monomer compositions at least containing a hydrophilic monomer and a hydrophobic monomer is suitably used. The hydrophilic monomer and the hydrophobic monomer are not particularly limited and known monomers can be used, for example. Examples of the hydrophobic monomer include styrene, a styrene derivative, alkyl(meth)acrylate, or benzyl(meth)acrylate, for example. Examples of the hydrophilic monomer include acrylic acid, methacrylic acid, or maleic acid, for example. The acid value of the resin dispersant is suitably 50 mgKOH/g or more and 550 mgKOH/g or less. The weight average molecular weight of the resin dispersant is suitably 1000 or more and 50000 or less.

The ratio (mass ratio) of the pigment to the resin dispersant is suitably within the range of 1:0.1 to 1:3.

In the first embodiment, a so-called self-dispersible pigment whose dispersibility is improved by modifying the pigment surface is used as the pigment. Examples of the self-dispersible pigment include a self-dispersible pigment which can be dispersed in a solvent by itself and which has an anionic hydrophilic group in the surface, for example. As a method for introducing the hydrophilic group into the particle surface of the pigment include oxidation treatment with oxidizers (for example, nitric acid, permanganate, dichromate, hypochlorite, ammonium persulfate, hydrogen peroxide, ozone, and the like), treatment with coupling agents, such as a silane compound, plasma treatment, and the like can be mentioned, for example.

The content of the pigment in the ink is suitably 0.5% by mass or more and 15.0% by mass or less and more suitably 1.0% by mass or more and 10.0% by mass or less based on the total ink mass.

The application amount to the recording medium of the ink is suitably 0.1 $g/m^2$ or more and 50 $g/m^2$ or less and more suitably 0.5 $g/m^2$ or more and 35 $g/m^2$ or less.

The ink contains resin particles in addition to the pigment. Due to the fact that the resin particles are contained, when heated to a temperature equal to or higher than the softening point ($Tm_p$) of the resin particles, the resin particles form a film as described above. Due to the resin film, the ink aggregation layer can be strongly bound to the recording medium. Moreover, due to the fact that the resin particles are softened, a printing layer can be flattened and a high definition image can be formed.

Materials of the resin particles are not particularly limited and known resin particles can be suitably used. Specific examples of the materials of the resin particles include, for example, polyolefin, polystyrene, polyurethane, polyester, polyether, polyurea, polyamide, polyvinyl alcohol, poly (meth)acrylic acid and a salt thereof, poly(meth)alkyl acrylate, polydiene, and the like. The materials may be used alone or in combination of two or more kinds thereof.

The mass average molecular weight of the resin particles is suitably 1,000 or more and 2,000,000 or less. The content of the resin particle in the ink is suitably 1% by mass or more and 50% by mass or less and more suitably 2% by mass or more and 40% by mass or less based on the total ink mass.

The resin particles are suitably added into a coating liquid in the form of a resin particle dispersion in which the resin particles are dispersed in liquid. A technique of dispersing the resin particles is not particularly limited. The resin particles are suitably self-dispersible resin particles. The self-dispersible resin particles include a homopolymer of monomers having a dissociative group or a copolymer of monomer compositions containing a monomer having a dissociative group, for example. Examples of the dissociative group include a carboxyl group, a sulfonic acid group, a phosphate group, and the like, for example. Examples of the monomers having the dissociative groups include acrylic acids or methacrylic acids, for example. Moreover, so-called emulsified dispersion resin particles in which the resin particles are dispersed with an emulsifier can also be suitably used. The emulsifier is not particularly limited and known surfactants can be used, for example. The surfactants are suitably nonionic and have the same charge as that of the resin particles.

The volume average particle diameter of the resin particles in the resin particle dispersion is suitably 10 nm or more and 1000 nm or less and more suitably 30 nm or more and 500 nm or less. The volume average particle diameter of the resin particles in the resin particle dispersion can be measured using a laser scattering particle size distribution meter, for example. As the laser scattering particle size distribution meter, a laser diffraction/scattering particle size distribution meter, LA-920 (HORIBA), can be used, for example.

The resin particle dispersion suitably contains additives for stabilization. Examples of the additives include n-hexadecane, dodecyl methacrylate, stearyl methacrylate, chlorobenzene, dodecyl mercaptan, olive oil, blue dye (Blue70), polymethyl methacrylate and the like, for example.

In this embodiment, the softening point of the resin particles is measured by the following method. Specifically, a solid image with a duty of 100% (Resolution of basic matrix; 1200 dpi×1200 dpi) is formed on a recording-medium: O.K. Topcoat (Basis weight of 127.9 g, Trade name, manufactured by Oji Paper Co., Ltd.) to which a 20% by mass aqueous solution of citric acid is applied with an application amount of 1.5 $g/m^2$ using an ink containing resin particles. Next, the recording medium is allowed to stand still in an oven in which the heating temperature can be changed for 20 minutes, and then the solid image is observed under a scanning electron microscope. Then, the minimum temperature at which the resin particles form a film is defined as the softening point. The softening point of the resin particles can be adjusted by the following methods. For example, when the resin particles are configured from a copolymer, the softening point can be adjusted by changing the ratio (addition ratio) of monomers forming the copolymer. The softening point of the resin particles can also be adjusted by adding a film forming assistant.

Herein, examples of the film forming assistant include organic solvents having affinity with resin, for example. Examples of the organic solvents include alkyl ethers, such as methyl cellosolve, ethyl cellosolve, butyl cellosolve, methyl carbitol, ethyl carbitol, butyl carbitol, and dipropylene glycol monomethyl ether, or benzyl alcohol but the organic solvents are not limited thereto. The film forming assistants may be used alone or in combination of two or more kinds thereof.

The ink may further contain a surfactant. Specific examples of the surfactant include Acetylenol EH (manufactured by Kawaken Fine Chemicals Co., Ltd., Trade name) and the like, for example. The content of the surfactant in the ink is suitably 0.01% by mass or more and 5.0% by mass or less based on the total ink mass.

The ink may further contain a solvent. As the solvent, water or water-soluble organic solvents can be mentioned, for example. Water is suitably water deionized by ion exchange or the like. The water-soluble organic solvents are not particularly limited and known water-soluble organic solvents can be used. Specific examples of the water-soluble organic solvents include glycerol, diethylene glycol, polyethylene glycol, 2-pyrrolidone, and the like, for example. The content of the solvent (for example, water or water-soluble organic solvent) in the ink is suitably 3% by mass or more and 70% by mass based on the total ink mass.

The ink may further contain additives as necessary in addition to the components mentioned above. Examples of the additives include a pH adjuster, an antirust, an antiseptic, an antifungal agent, an antioxidant, a reduction prevention agent, a water-soluble resin and a neutralizer thereof, a viscosity modifier, or the like, for example. Liquid composition applying step The liquid composition applying step is a step of applying a liquid composition containing an agglomerating component which agglomerates the pigment or the resin particles in the ink and wax particles to a recording medium in such a manner as to be at least partially overlapped with a region to which the ink is applied. As described above, the order of the ink applying step and the liquid composition applying step is not limited and any one of the steps may be performed first.

A method of applying the liquid composition to the recording medium is not particularly limited and known methods can be used as appropriate, for example. Examples of techniques of applying the liquid composition include a die coating method, a blade coating method, a method employing a gravure roller, a method employing an offset roller in combination therewith, and the like, for example. Examples of a technique capable of applying the liquid composition at high speed and with high accuracy include a method using an ink jet device.

The liquid composition contains an agglomerating component which agglomerates a pigment or resin particles and wax particles. The agglomerating component can reduce the dispersion state of the pigment and the resin particles in the ink to agglomerate these components, whereby the agglomerating component demonstrates an effect of suppressing bleeding or beading in image formation.

The agglomerating component is not particularly limited and polyvalent metallic salts, organic acids, cation polymers, porous particles, and the like are mentioned, for example. Among the above, at least one selected from polyvalent metallic salts and organic acids is suitable. The agglomerating components may be used alone or in combination of two or more kinds thereof.

As the polyvalent metallic salts, salts of metals having a valence of at least divalent can be used. As the salt type, carbonate, sulfate, nitrate, hydrochloride, borate, phosphate, and the like are mentioned, for example. Examples of metal ions include divalent metal ions, such as $Ca^{2+}$, $Cu^{2+}$, $Ni^{2+}$, $Mg^{2+}$, $Sr^{2+}$, $Ba^{2+}$, or $Zn^{2+}$, and trivalent metal ions, such as $Fe^{3+}$, $Cr^{3+}$, $Y^{3+}$, or $Al^{3+}$, for example.

Examples of the organic acids include, for example, oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid, dioxysuccinic acid, and the like.

The content of the agglomerating component in the liquid composition is suitably 5% by mass or more and 90% by mass or less and more suitably 10% by mass or more and 60% by mass or less.

The wax particles to be used in this embodiment have a melting point higher than the softening point of the resin particles contained in the ink. The penetration specified by JIS K2235 of the wax particles is 5 or less. The wax particles include wax particles X having a particle diameter equal to or larger than the film thickness D represented by Expression (1) or (2) shown later.

As the wax particles, natural wax or synthetic wax can be mentioned, for example. As the natural wax, petroleum-based wax, plant-based wax, animal-and-plant-based wax, or the like is mentioned, for example. As the petroleum-based wax, paraffin wax, microcrystalline wax, or petrolatum is mentioned, for example. As the plant-based wax, carnauba wax, candelilla wax, rice wax, Japan tallow, and the like are mentioned, for example. As the animal-and-plant-based wax, lanolin, beeswax, or the like is mentioned, for example. As the synthetic wax, synthetic hydrocarbon-based wax, a modified wax type, or the like is mentioned, for example. As the synthetic hydrocarbon-based wax, polyethylene wax, Fischer-Tropsch wax, or the like is mentioned, for example. As the modified wax type, a paraffin wax derivative, a montan wax derivative, a microcrystalline wax derivative, or the like is mentioned, for example. The wax mentioned above may be used alone or in combination of two or more kinds thereof.

The wax particles are suitably added to the liquid composition in the form of a wax particle dispersion in which the wax particles are dispersed in liquid. The wax particles are suitably formed by dispersing a wax component with a dispersant. The dispersant is not particularly limited and known dispersants can be used, for example. It is suitable to select the dispersant considering the stability of the dispersion state in the liquid composition. For example, when organic acid is used as the agglomerating component, the dispersant is suitably a nonionic dispersant, a cationic dispersant, or an anionic dispersant having a pKa equal to or lower than the pKa of the organic acid and a nonionic dispersant is more suitable. When polyvalent metallic salt is used as the agglomerating component, for example, a nonionic dispersant or a cationic dispersant is suitable and a nonionic dispersant is more suitable.

The average particle diameter (50% particle diameter based on the number of particles) of the wax particles is suitably equal to or larger than the film thickness D represented by Expression (1) or (2). When the average particle diameter of the wax particles is equal to or larger than the film thickness D, a protective film containing a wax component can be effectively formed on the ink film. The average particle diameter (90% particle diameter based on the number of particles) of the wax particles is suitably 5 times or less of the film thickness D. By setting the average particle diameter (90% particle diameter based on the number of particles) of the wax particles to be 5 times or less of the film thickness D, the generation of irregularities in the surface of the protective film due to the wax component can be suppressed, so that the optical density can be improved. The average particle diameter (90% particle diameter based on the number of particles) of the wax particles is suitably 10 μm or less.

In the present invention, the wax particles include wax particles X having a particle diameter equal to or larger than the film thickness D represented by Expression (1) or (2) shown later. In the present invention, the application amount to the recording medium of the wax particles X having a particle diameter equal to or larger than the film thickness D needs to be 0.01 $g/m^2$ or more. When the application amount of the wax particles X is less than 0.01 $g/m^2$, desired scratch resistance cannot be obtained. The application amount of the wax particles X is suitably 0.03 $g/m^2$ or more. The application amount of the wax particles X is suitably 0.5 $g/m^2$ or less and more suitably 0.3 $g/m^2$ or less. When the application amount of the wax particles X is larger than 0.5 $g/m^2$, an aqueous ink is likely to be repelled by the wax component, and dots are likely to be blurred in some cases.

The application amount to the recording medium of the liquid composition is suitably 0.1 $g/m^2$ or more and 5.0 $g/m^2$ or less. When the application amount of the liquid composition is 0.1 $g/m^2$ or more, an effect of suppressing bleeding can be effectively obtained. When the application amount of the liquid composition is 5.0 $g/m^2$ or less, a deterioration of the texture of the recording medium can be effectively prevented.

Herein, the film thickness D in the first embodiment is calculated by the following expression (1). In the first embodiment, the pigment is a self-dispersible pigment and the self-dispersible pigment and the resin particles contained in the ink serve as a solid content which affects the film thickness D.

$$D=a\times(b_1/c_1+b_2/c_2) \quad \text{Expression (1):}$$

(In the expression, a is the application amount ($g/m^2$) to the recording medium of the ink, $b_1$ is the content (% by mass) of the self-dispersible pigment in the ink, $c_1$ is the specific gravity of the self-dispersible pigment, $b_2$ is the content (% by mass) of the resin particles in the ink, and $c_2$ is the specific gravity of the resin particles.)

The film thickness D in the second embodiment is calculated by the following expression (2). In the second embodiment, the ink further contains a resin dispersant which disperses the pigment in addition to the pigment and the resin particles. The pigment, the resin dispersant, and the resin particles contained in the ink serve as a solid content which affects the film thickness D. When the resin particles are dispersed by the resin, the dispersion resin may also affect the film thickness D. On the other hand, it is very difficult to separate the resin particles and the dispersion resin. Then, in that case, the calculation is performed supposing that the "content of the resin particles" in the following expression is the "content of the resin particles also including the dispersion resin" and the "specific gravity of the resin particles" is the "specific gravity of the resin particles also including the dispersion resin".

$$D=a\times(b_1/c_1+b_2/c_2+b_3/c_3) \quad \text{Expression (2):}$$

(In the expression, a is the application amount ($g/m^2$) to a recording medium of the ink, $b_1$ is the content (% by mass) of the pigment in the ink, $c_1$ is the specific gravity of the pigment, $b_2$ is the content (% by mass) of the resin particles in the ink, $c_2$ is the specific gravity of the resin particles, $b_3$ is the content (% by mass) of the resin dispersant in the ink, and $c_3$ is the specific gravity of the resin dispersant.)

The melting point of the wax particles can be measured according to the temperature measurement pattern of ASTM D3418. More specifically, the melting point of the wax particles can be a value of the peak top of the maximum melting temperature measured using DSC-7 (PerkinElmer, Inc.) at a temperature elevation rate of 10° C./min according to the temperature measurement pattern of ASTM D3418.

The melting point of the wax particles is suitably 25° C. or more and 200° C. or less, more suitably 40° C. or more and 150° C. or less, and particularly suitably 60° C. or more and 120° C. or less. A difference between the melting point of the wax particles and the softening point of the resin particles is suitably 5° C. or more and more suitably 10° C. or more.

The particle diameter of the wax particles can be obtained by applying a liquid composition to a recording medium, analyzing the obtained image of the wax particles using a scanning electron microscope, and then measuring the maximum particle diameter of the wax particles. As a specific example of the scanning electron microscope, SU-70 (Trade name, manufactured by Hitachi, Ltd.) is mentioned. The particle size distribution of the wax particles can be obtained by measuring the maximum particle diameter of at least 10000 wax particles. The particle diameter of each wax particle is measured by the measurement method, and then the wax particles having a particle diameter equal to or larger than the film thickness D represented by Expression (1) or (2) are defined as the wax particles X. The content of the wax particles X in the wax particles is suitably 1% or more and more suitably 5% or more.

The average particle diameter of the wax particles is obtained as the 50% particle diameter based on the number of particles of the particle diameter distribution obtained by the measurement. The average particle diameter (50% particle diameter based on the number of particles $D_{50}$) of the wax particles is suitably 0.5 μm or more and 10 m or less and more suitably 1 μm or more and 4 μm or less.

The application amount of the wax particles X can be calculated from the particle size distribution measured by the method described above. The application amount to the recording medium of the wax particles X can be calculated by the following expression (3), for example.

$$F=A\times B\times C \quad \text{Expression (3):}$$

$$C=1-(\Sigma(nj-1\times dj-1\hat{}3)/\Sigma(nk\times dk\hat{}3))$$

F: Application amount of wax particles X

A: Application amount of liquid composition [$g/m^2$]

B: Ratio of wax particles in liquid composition (Total content of wax particles/Total amount of liquid composition)

C: Ratio of wax particles X in wax particles (Number of wax particles X/Total number of wax particles)

dj=D when it is supposed that the number of particles each having each particle diameter of d1, d2, . . . dj, . . . dk is n1, n2, . . . nj, . . . nk.

The liquid composition may contain an appropriate amount of water and an organic solvent. Water is suitably water deionized by ion exchange or the like. The organic solvent is not particularly limited and known organic solvents can be used, for example.

The liquid composition may contain various kinds of resin insofar as the effects of the invention of this application are not impaired. Due to the fact that an appropriate resin is contained, the adhesiveness to a recording medium, such as paper, when transferring can be improved and the mechanical strength of an image to be finally obtained can be improved. Materials of the resin are not particularly limited insofar as the materials can coexist with the ink agglomerating component.

The liquid composition may contain a surfactant and a viscosity modifier. The components can adjust the surface tension and the viscosity of the liquid composition as appropriate. The surfactant and the viscosity modifier are not particularly limited insofar as the surfactant and the viscosity modifier can coexist with the agglomerating component.

As a specific example of the surfactant, Acetylenol E100 (manufactured by Kawaken Fine Chemicals Co., Ltd.) and the like are mentioned.

As a recording head of an ink jet system which can be used for applying the ink or the liquid composition include, for example, an aspect (thermal type recording head) of causing film boiling in the ink by an electrothermal converter to form air bubbles to thereby eject the ink, an aspect (recording head of a piezoelectric system) of ejecting the ink by an electromechanical converter, and an aspect of ejecting the ink utilizing static electricity are mentioned. Among the above, the thermal type recording head is suitably used.

The aspect of the recording head of an ink jet system is not particularly limited. A recording head (line head) of a line form in which ejection ports which eject ink in a direction vertical to the conveyance direction (axial direction in the case of a drum shape) of a recording medium and a head (serial head) which performs recording while moving a head for scanning in a direction vertical to the conveyance direction of a recording medium can also be used.

Heating Step

In the present invention, the heating step is a step of heating the recording medium to which the liquid composition and the ink are applied and the heating temperature $T_H$ in the heating step, the softening point $Tm_p$ of the resin particles, and the melting point $Tm_w$ of the wax particles satisfy the relationship of $Tm_p<Tm_w\leq T_H$. The heating temperature of the recording medium in the heating step is suitably 25° C. or more and 200° C. or less and more suitably 25° C. or more and 150° C. or less.

In the present invention, the heating step may be performed in one step or may be divided into two or more steps insofar as the final reaching temperature satisfies the relational expression above. For example, the heating step may have a first heating step of heating the recording medium to a temperature equal to or higher than the softening point of the resin particles and less than the melting point of the wax particles and a second heating step of heating the recording medium to a temperature equal to or higher than the melting point of the wax particles after the first heating step.

A heating method is not particularly limited insofar as the recording medium (specifically an image of the recording medium) can be heated to a predetermined temperature. As the heating method, a method employing hot wind, a method employing radiant heat of IR lamp or the like, and the like are mentioned, for example.

In the second heating step, a printing portion can be pressurized in the state where the wax particles are melted. The pressurization to the recording medium can be performed at a temperature equal to or higher than the melting point of the wax particles. For example, surface flatness and smoothness can be improved by pressurizing the recording medium, on which an image is formed, with a roller. The pressurization may be performed while applying heat by pressurizing the recording medium with a heated roller. In the state where the image of the recording medium is heated to a temperature equal to or higher than the melting point of the wax particles, the pressurization with a roller may be performed.

The roller is not particularly limited and known rollers can be used, for example. From the viewpoint of preventing the generation of offset and the like of a printing surface to the roller, the roller is suitably a roller having silicon rubber, fluororesin, and the like on the surface.

Drying Step

It is suitable to provide a drying step of reducing the liquid content, such as moisture, from the formed image after the heating step. A drying method is not particularly limited and known drying methods can be applied. As the drying method, a heating method, a method of sending low humidity air, a depressurizing method, a method including the methods in combination, and the like are mentioned, for example. The drying can also be performed by natural drying.

EXAMPLES

Next, the present invention is specifically described with reference to Examples and Comparative Examples. The present invention is not particularly limited by the following Examples without exceeding the scope. In the following description, "part(s)" or "%" is based on the mass unless otherwise particularly specified.

Ink Jet Image Forming Apparatus

Figure 3:
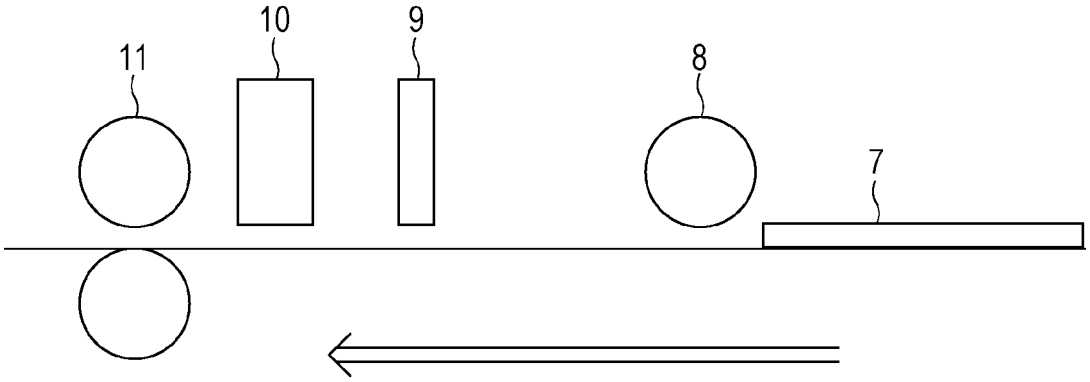
FIG. 3 is a schematic view showing an example of the configuration of an image forming apparatus used in Examples.

FIG. 3 is a schematic view showing an example of the configuration of an image forming apparatus which executes an ink jet image forming method. In FIG. 3, a recording medium 7 is conveyed in a direction indicated by the arrow (recording medium conveyance direction). First, a liquid composition is applied to the recording medium 7 by a roller type coating device 8. Next, an ink is ejected to the recording medium, to which the liquid composition is applied, with an ink jet device 9 having an ink jet head to form an image. Next, the image formed on the recording medium is dried by a heating device 10. Next, the image is heated and pressurized by a pressurization roller 11 to be fixed to the recording medium. In this example, a thermal type recording head was used as the ink jet device 9.

Preparation of Liquid Composition

Materials were mixed with the compositions shown in Table 1 to obtain liquid compositions 1 to 8.

TABLE 1

Preparation conditions of liquid composition (Unit % by mass)

| | Liquid composition 1 | Liquid composition 2 | Liquid composition 3 | Liquid composition 4 | Liquid composition 5 | Liquid composition 6 | Liquid composition 7 | Liquid composition 8 |
|---|---|---|---|---|---|---|---|---|
| Citric Acid | 20.0 | 20.0 | 20.0 | 20.0 | 20.0 | 20.0 | 20.0 | 20.0 |
| EMUSTAR6315D (manufactured by NIPPON SEIRO CO., LTD.) Average particle diameter 3.4 μm Melting point 113° C. | 5.0 | | | | | | | 1.0 |

TABLE 1-continued

Preparation conditions of liquid composition (Unit % by mass)

| | Liquid composition 1 | Liquid composition 2 | Liquid composition 3 | Liquid composition 4 | Liquid composition 5 | Liquid composition 6 | Liquid composition 7 | Liquid composition 8 |
|---|---|---|---|---|---|---|---|---|
| EMUSTAR6315D (manufactured by NIPPON SEIRO CO., LTD.) Average particle diameter 1.0 μm Melting point 113° C. | | 5.0 | | | | | | |
| EMUSTAR6315D (manufactured by NIPPON SEIRO CO., LTD.) Average particle diameter 0.4 μm Melting point 113° C. | | | 5.0 | | | | | |
| HNP51 Nonionic dispersion (manufactured by NIPPON SEIRO CO., LTD.) Average particle diameter 1.0 μm Melting point 77° C. | | | | 5.0 | | | | |
| HYDRIN L-703-35 (manufactured by CHUKYO YUSHI CO., LTD.) Average particle diameter 1.0 μm Melting point 70° C. | | | | | 5.0 | | | |
| HYDRAN CP-7020 (manufactured by DIC Corporation) | | | | | | 10.0 | | |
| BYK347 (manufactured by BYK Chemie) | | | | | | 0.5 | | |
| Acetylenol E100 (manufactured by Kawaken Fine Chemicals Co., Ltd.) | 1.0 | 1.0 | 1.0 | 1.0 | 1.0 | 1.0 | 1.0 | 1.0 |
| Ion exchange water | 74.0 | 74.0 | 74.0 | 74.0 | 74.0 | 66.5 | 79.0 | 78.0 |

Preparation of Ink

Production of Pigment Dispersion 10 parts of carbon black having a specific surface area of 220 $m^2/g$ and a DBP oil absorption amount of 105 mL/100 g, 30 parts of styrene-acrylic acid copolymer (Acid value of 200 mgKOH/g, Weight average molecular weight of 9,000, Aqueous solution of 20% solid content, Neutralizer: potassium hydroxide) as a resin dispersant, and 60 parts of pure water were mixed. Next, the mixture was charged into a batch type vertical sand mill (manufactured by AIMEX CO., Ltd.), 200 parts of zirconia beads having a diameter of 0.3 mm were charged thereinto, and dispersion treatment was performed for 5 hours under water cooling. The obtained dispersion liquid was put into a centrifugal separator to remove big and coarse particles, whereby a pigment dispersion having a pigment concentration of 10% was obtained.

Preparation of Dispersion of Resin Particles 1

10 parts of ethyl methacrylate, 10 parts of methyl methacrylate, and 2 parts of 2,2'-azobises(2-methylbutyronitrile) were mixed, and then the mixture was stirred for 0.5 hour. This mixture was added dropwise to 78 parts of a 3% NIKKOL BC15 (manufactured by Nikko Chemicals Co., Ltd.) aqueous solution, and then stirred for 0.5 hour. Next, the resultant mixture was irradiated with ultrasonic waves with an ultrasonic irradiation machine for 3 hours. Subsequently, a polymerization reaction was performed under a nitrogen atmosphere at 80° C. for 4 hours, whereby a dispersion of resin particles 1 having 25% solid content was obtained. The volume average particle diameter of the obtained resin particles 1 was 210 nm. Tg was 75° C.

Preparation of dispersion of resin particles 2

20 parts of ethyl methacrylate and 2 parts of 2,2'-azobises (2-methylbutyronitrile) were mixed, and then stirred for 0.5 hour. This mixture was added dropwise to 78 parts of a 3% NIKKOL BC15 aqueous solution, and then stirred for 0.5 hour. Next, the resultant mixture was irradiated with ultrasonic waves with an ultrasonic irradiation machine for 3 hours. Subsequently, a polymerization reaction was performed under a nitrogen atmosphere at 80° C. for 4 hours, whereby a dispersion of resin particles 2 having 25% solid content was obtained. The volume average particle diameter of the obtained resin particles 2 was 200 nm. Tg was 60° C.

Preparation of Dispersion of Resin Particles 3

20 parts of methyl methacrylate and 2 parts of 2,2'-azobises (2-methylbutyronitrile) were mixed, and then stirred for 0.5 hour. This mixture was added dropwise to 78 parts of a 3% NIKKOL BC15 aqueous solution, and then stirred for 0.5 hour. Next, the resultant mixture was irradiated with ultrasonic waves with an ultrasonic irradiation machine for 3 hours. Subsequently, a polymerization reaction was performed under a nitrogen atmosphere at 80° C. for 4 hours, whereby a dispersion of resin particles 3 having 25% solid content was obtained. The volume average particle diameter of the obtained resin particles 3 was 200 nm. Tg was 110° C.

Ink Composition

Materials were mixed in such a manner as to have the compositions shown in Table 2, and further, the mixture was pressure-filtered with a membrane filter (C300A manufactured by ADVANTEC) having a pore size of 3.0μ, whereby ink 1 to ink 3 were obtained.

TABLE 2

Preparation conditions of ink (Unit: % by mass)

| | Ink 1 | Ink 2 | Ink 3 |
|---|---|---|---|
| Pigment dispersion (solid content) | 3.0 | 3.0 | 3.0 |
| Resin particles 1 | 8.0 | | |

TABLE 2-continued

| Preparation conditions of ink | | | |
|---|---|---|---|
| | | (Unit: % by mass) | |
| | Ink 1 | Ink 2 | Ink 3 |
| Resin particles 2 | | 8.0 | |
| Resin particles 3 | | | 8.0 |
| Glycerol | 10.0 | 10.0 | 10.0 |
| Acetylenol E100 (manufactured by Kawaken Fine Chemicals Co., Ltd.) | 0.5 | 0.5 | 0.5 |
| Ion exchange water | 78.5 | 78.5 | 78.5 |

Measurement of Softening Point of Resin Particles in Ink

Using the ink above, 1.5 g/m$^2$ of the liquid composition 7 was applied to a recording medium O.K. Topcoat (Basis weight of 127.9 g), and one kind of ink was ejected from one ejection port array with a resolution of a basic matrix of 1200 dpi (width)×1200 dpi (length), whereby a mass-shaped solid image (200 mm×200 mm) with a duty of 100% was formed on the recording medium. The recording medium on which the image was formed was allowed to stand still in an oven maintained at each temperature for 20 minutes. The temperature of the oven was changed in increments of 1° C., whereby a plurality of samples were obtained. The obtained samples were observed for the shape of the resin particles using a scanning electron microscope, and the temperature at which the resin particles formed a film was defined as the softening point. The softening point of the resin particles 1 in the ink 1 was 75° C. The softening point of the resin particles 2 in the ink 2 was 60° C. The softening point of the resin particles 3 in the ink 3 was 110° C.

Image Forming Method

Using the liquid compositions and the ink obtained above, images of Examples 1 to 9 and Comparative Examples 1 to 6 were formed by the following method.

Example 1

(A) Liquid Composition Applying Step

As a recording medium, O.K. Topcoat+ (Trade name, manufactured by Oji Paper Co., Ltd.) was used. The liquid composition 1 was applied to the recording medium with an application amount of 1.5 g/m$^2$ with a roller type coating device. The application amount was calculated by a gravimetric technique.

(B) Ink Applying Step

One second after the application of the liquid composition, an ink image having a desired pattern was formed on the recording medium to which the liquid composition 1 was applied using the ink 1 with an ink jet device (Nozzle arrangement density of 1200 dpi, Ejection amount of 3.5 ng). One kind of ink was ejected from one ejection port array with a resolution of a basic matrix of 1200 dpi (width)×1200 dpi (length), whereby a mass-shaped solid image (200 mm×200 mm) with a duty of 100% was formed on the recording medium. One liquid droplet is 3.5 ng.

In this example, since the solid content in the ink includes the pigment, the resin particles, and the resin dispersant, the film thickness D is represented by Expression (2).

$$D=a\times(b_1/c_1+b_2/c_2+b_3/c_3) \quad \text{Expression (2):}$$

(In the expression, a is the application amount (g/m$^2$) to the recording medium of the ink, $b_1$ is the content (% by mass) of the pigment in the ink, $c_1$ is the specific gravity of the pigment, $b_2$ is the content (% by mass) of the resin particles in the ink, $c_2$ is the specific gravity of the resin particles, $b_3$ is the content (% by mass) of the resin dispersant in the ink, and $c_3$ is the specific gravity of the resin dispersant.)

In this experiment, a, b, and c are as follows.

Ink ejection amount: a=7.8 g/m$^2$=0.078 g/cm$^2$ (determined by a gravimetric technique)

Pigment: $b_1$=3% by mass (Specific gravity $c_1$=1.5 g/cm$^3$)

Resin particles: $b_2$=8% by mass (Specific gravity $c_2$=1.1 g/cm$^3$)

Resin dispersant: $b_3$=1.8% by mass (Specific gravity $c_3$=1.1 g/cm$^3$), Therefore, D=0.9 μm is given.

The particle diameter of the wax particles was determined by applying the liquid composition to the recording medium, analyzing the obtained image of the wax particles using a scanning electron microscope, and then measuring the maximum particle diameter of the wax particles. As the scanning electron microscope, SU-70 (Trade name, manufactured by Hitachi, Ltd.) was used. The particle size distribution of wax particles was obtained by measuring the maximum particle diameter of at least 10000 wax particles. The particle diameter of each wax particle was measured by the measurement method, and then the wax particles having a particle diameter equal to or larger than the film thickness D represented by Expression (1) or (2) were defined as the wax particles X. The proportion of the wax particles X in the wax particles (Number of wax particles X/Total number of wax particles) is a value obtained by dividing the number of the wax particles X having a particle diameter equal to or larger than the film thickness D by the total number of "at least 10000 wax particles" whose maximum particle diameter was measured when obtaining the particle size distribution using a scanning electron microscope above.

The application amount of the wax particles X in an image printing portion was calculated by the following expression (3).

$$F=A\times B\times C \quad \text{Expression (3):}$$

$$C=1-(\Sigma(nj-1\times dj-1\hat{}3)/\Sigma(nk\times dk\hat{}3))$$

Herein,

F: Application amount of wax particles X,

A: Application amount of liquid composition=1.5 g/m$^2$,

B: Ratio of wax particles in liquid composition: 0.05, and

C: Ratio of wax particles X in wax particles: 0.99, and therefore F=0.07 g/m$^2$ was given.

After the ink was ejected, 60° C. warm air was sprayed to the image for 3 seconds with the heating device 10 to dry the image. The pressurization roller 11 was heated to 120° C. and the nip pressure was set to 2 MPa.

Example 2

An image was formed and fixed to a recording medium in the same manner as in Example 1, except ejecting one kind of ink from one ejection port array with a resolution of the basic matrix of 1,200 dpi (width)×1,200 dpi (length) to form a mass-shaped solid image (200 mm×200 mm) with a duty of 200% on the recording medium.

Example 3

An image was formed and fixed to a recording medium in the same manner as in Example 1, except ejecting one kind of ink from one ejection port array with a resolution of the basic matrix of 1,200 dpi (width)×1,200 dpi (length) to form a mass-shaped solid image (200 mm×200 mm) with a duty of 300% on the recording medium.

Example 4

An image was formed and fixed to a recording medium in the same manner as in Example 1, except using the liquid composition 8 in place of the liquid composition 1.

Example 5

An image was formed and fixed to a recording medium in the same manner as in Example 1, except using the liquid composition 2 in place of the liquid composition 1.

Example 6

An image was formed and fixed to a recording medium in the same manner as in Example 5, except ejecting one kind of ink from one ejection port array with a resolution of the basic matrix of 1,200 dpi (width)×1,200 dpi (length) to form a mass-shaped solid image (200 mm×200 mm) with a duty of 200% on the recording medium.

Example 7

An image was formed and fixed to a recording medium in the same manner as in Example 5, except ejecting one kind of ink from one ejection port array with a resolution of the basic matrix of 1,200 dpi (width)×1,200 dpi (length) to form a mass-shaped solid image (200 mm×200 mm) with a duty of 300% on the recording medium.

Example 8

An image was formed and fixed to a recording medium in the same manner as in Example 1, except applying the liquid composition 1 to the recording medium with an application amount of 4.5 g/m$^2$ with a roller type coating device.

Example 9

An image was formed and fixed to a recording medium in the same manner as in Example 1, except using the ink 2 in place of the ink 1 and using the liquid composition 4 in place of the liquid composition 1.

Comparative Example 1

An image was formed and fixed to a recording medium in the same manner as in Example 1, except using the liquid composition 3 in place of the liquid composition 1.

Comparative Example 2

An image was formed and fixed to a recording medium in the same manner as in Example 1, except using the ink 3 in place of the ink 1 and using the liquid composition 4 in place of the liquid composition 1.

Comparative Example 3

An image was formed and fixed to a recording medium in the same manner as in Example 1, except setting the temperature of the pressurization roller 11 to 90° C.

Comparative Example 4

An image was formed and fixed to a recording medium in the same manner as in Example 1, except using the ink 2 in place of the ink 1 and using the liquid composition 5 in place of the liquid composition 1.

Comparative Example 5

An image was formed and fixed to a recording medium in the same manner as in Example 1, except using the liquid composition 6 in place of the liquid composition 1.

Comparative Example 6

An image was formed and fixed to a recording medium in the same manner as in Example 1, except using the liquid composition 7 in place of the liquid composition 1.

The results are shown in Table 3.

Image Quality Evaluation

The quality of the images obtained by Examples 1 to 9 and Comparative Examples 1 to 6 was evaluated by visual check and image concentration (OD) based on the following judgment criteria. The image concentration (OD) was measured using RD918 (Trade name, manufactured by Macbeth).

Judgment Criteria

A: The solid image can be uniformly formed and the OD is 1.8 or more.

B: The solid image can be almost uniformly formed and the OD is 1.6 or more.

C: Color unevenness is observed, a solid image cannot be formed, and the OD is lower than 1.6.

Scratch Resistance Evaluation of Image

The recording medium on which the image was formed by the image forming method described above is cut into a strip shape with a width of 25 mm. The recording medium cut into the strip shape was subjected to an abrasion test of 200 times at a load of 500 g was performed using an abrasion resistance tester (manufactured by Imoto Machinery Co., Ltd.) which is tester of Japan Society for the Promotion of Science, and then the scratch resistance of the recording medium was visually evaluated.

Judgment Criteria

A: There is no scratch mark within a print surface.

B: There is a scratch mark within a print surface but the back ground color is not exposed.

C: The background color of the print surface is exposed.

TABLE 3

Image formation conditions and Evaluation results.

| | Ink | Liquid composition | Heating temperature (° C.) | Melting point $Tm_p$ of wax particles (° C.) | Softening point $Tm_p$ of resin particles (° C.) | Average particle diameter of wax particles (μm) | Application amount of wax particles (g/m$^2$) | Film thickness D (μm) | Penetration of wax particles | Image quality evaluation | Image scratch resistance evaluation |
|---|---|---|---|---|---|---|---|---|---|---|---|
| Example 1 | Ink 1 | Liquid composition 1 | 120 | 113 | 75 | 3.4 | 0.07 | 0.9 | 1 | A | A |
| Example 2 | Ink 1 | Liquid composition 1 | 120 | 113 | 75 | 3.4 | 0.07 | 1.8 | 1 | A | A |
| Example 3 | Ink 1 | Liquid composition 1 | 120 | 113 | 75 | 3.4 | 0.06 | 2.7 | 1 | A | A |

TABLE 3-continued

Image formation conditions and Evaluation results.

| | Ink | Liquid composition | Heating temperature (° C.) | Melting point $Tm_w$ of wax particles (° C.) | Softening point $Tm_p$ of resin particles (° C.) | Average particle diameter of wax particles (μm) | Application amount of wax particles (g/m$^2$) | Film thickness D (μm) | Penetration of wax particles | Image quality evaluation | Image scratch resistance evaluation |
|---|---|---|---|---|---|---|---|---|---|---|---|
| Example 4 | Ink 1 | Liquid composition 8 | 120 | 113 | 75 | 3.4 | 0.01 | 2.7 | 1 | A | B |
| Example 5 | Ink 1 | Liquid composition 2 | 120 | 113 | 75 | 1.0 | 0.07 | 0.9 | 1 | A | A |
| Example 6 | Ink 1 | Liquid composition 2 | 120 | 113 | 75 | 1.0 | 0.06 | 1.8 | 1 | A | A |
| Example 7 | Ink 1 | Liquid composition 2 | 120 | 113 | 75 | 1.0 | 0.03 | 2.7 | 1 | A | A |
| Example 8 | Ink 1 | Liquid composition 1 | 120 | 113 | 75 | 3.4 | 0.22 | 0.9 | 1 | B | A |
| Example 9 | Ink 2 | Liquid composition 4 | 120 | 77 | 60 | 1.0 | 0.06 | 0.9 | 4 | A | A |
| Comparative Example 1 | Ink 1 | Liquid composition 3 | 120 | 113 | 75 | 0.4 | <0.01 | 0.9 | 1 | A | C |
| Comparative Example 2 | Ink 3 | Liquid composition 4 | 120 | 77 | 110 | 1.0 | 0.06 | 0.9 | 4 | A | C |
| Comparative Example 3 | Ink 1 | Liquid composition 1 | 90 | 113 | 75 | 3.4 | 0.07 | 0.9 | 1 | C | A |
| Comparative Example 4 | Ink 2 | Liquid composition 5 | 120 | 70 | 60 | 1.0 | 0.06 | 0.9 | 9 | A | C |
| Comparative Example 5 | Ink 1 | Liquid composition 6 | 120 | — | 75 | — | — | 0.9 | — | A | C |
| Comparative Example 6 | Ink 1 | Liquid composition 7 | 120 | — | 75 | — | — | 0.9 | — | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-190303, filed Sep. 18, 2014 which is hereby incorporated by reference herein in its entirety.

What is claimed is:

1. An image forming method, comprising:

a liquid composition applying step of applying a liquid composition to a recording medium;

an ink applying step of applying an ink to the recording medium in such a manner as to be at least partially overlapped with a region to which the liquid composition is applied;

and a heating step of heating the recording medium to which the liquid composition and the ink are applied, wherein the ink contains a self-dispersible pigment and resin particles, the liquid composition contains:

an agglomerating component of agglomerating at least either the self-dispersible pigment or the resin particles; and wax particles, a heating temperature $T_H$ in the heating step, a softening point $Tm_p$ of the resin particles, and a melting point $Tm_w$ of the wax particles satisfy a relationship of $Tm_p<Tm_w\leq T_H$, a penetration specified by JIS K2235 of the wax particle is 5 or less, and an application amount to the recording medium of wax particles X having a particle diameter equal to or larger than a film thickness D represented by Expression (1) shown below among the wax particles is 0.01 g/m$^2$ or more;

$$D=a\times(b_1/c_1+b_2/c_2), \quad \text{Expression (1):}$$

wherein, in the expression, a is an application amount (g/m$^2$) to the recording medium of the ink, $b_1$ is a content (% by mass) of the self-dispersible pigment in the ink, $c_1$ is a specific gravity of the self-dispersible pigment, $b_2$ is a content (% by mass) of the resin particles in the ink, and $c_2$ is a specific gravity of the resin particles.

2. The image forming method according to claim 1, wherein the application amount to the recording medium of the wax particles X is 0.5 g/m$^2$ or less.

3. The image forming method according to claim 1, wherein the recording medium is pressurized in the heating step.

4. The image forming method according to claim 1, wherein an average particle diameter of the wax particles is equal to or larger than the film thickness D.

5. An image forming method, comprising:

a liquid composition applying step of applying a liquid composition to a recording medium;

an ink applying step of applying an ink to the recording medium in such a manner as to be at least partially overlapped with a region to which the liquid composition is applied; and a heating step of heating the recording medium to which the liquid composition and the ink are applied, wherein the ink contains a pigment, a resin dispersant, and resin particles, the liquid composition contains:

an agglomerating component of agglomerating at least either the pigment or the resin particles; and wax particles, a heating temperature $T_H$ in the heating step, a softening point $Tm_p$ of the resin particles, and a melting point $Tm_w$ of the wax particles satisfy a relationship of $Tm_p<Tm_w\leq T_H$, a penetration specified by JIS K2235 of the wax particles is 5 or less, and an application amount to the recording medium of wax particles X having a particle diameter equal to or larger than a film thickness D represented by the following expression (2) among the wax particles is 0.01 g/m$^2$ or more;

$$D=a\times(b_1/c_1+b_2/c_2+b_3/c_3), \quad \text{Expression (2):}$$

wherein, in the expression, a is an application amount (g/m$^2$) to the recording medium of the ink, $b_1$ is a content (% by mass) of the pigment in the ink, $c_1$ is a specific gravity of the pigment, $b_2$ is a content (% by mass) of the resin particles in the ink, $c_2$ is a specific gravity of the resin particles, $b_3$ is a content (% by mass) of the resin dispersant in the ink, and $c_3$ is a specific gravity of the resin dispersant.

6. The image forming method according to claim 5, wherein the application amount to the recording medium of the wax particles X is 0.5 g/m$^2$ or less.

7. The image forming method according to claim 5, wherein the recording medium is pressurized in the heating step.

8. The image forming method according to claim 5, wherein an average particle diameter of the wax particles is equal to or larger than the film thickness D.

* * * * *